US009947999B2

(12) United States Patent
Tsai

(10) Patent No.: US 9,947,999 B2
(45) Date of Patent: Apr. 17, 2018

(54) BALANCED ANTENNA

(71) Applicant: TRANS ELECTRIC CO., LTD., Changhua (TW)

(72) Inventor: Kun-Cheng Tsai, Changhua (TW)

(73) Assignee: TRANS ELECTRIC CO., LTD., Changhua (TW)

( * ) Notice: Subject to any disclaimer, the term of this patent is extended or adjusted under 35 U.S.C. 154(b) by 360 days.

(21) Appl. No.: 14/972,375

(22) Filed: Dec. 17, 2015

(65) Prior Publication Data

US 2017/0033459 A1 Feb. 2, 2017

(30) Foreign Application Priority Data

Jul. 31, 2015 (TW) ..... 104212392 U

(51) Int. Cl.

| | |
|---|---|
| ***H01Q 1/38*** | (2006.01) |
| ***H01Q 9/16*** | (2006.01) |
| ***H01Q 9/06*** | (2006.01) |
| ***H01Q 5/371*** | (2015.01) |
| ***H01Q 9/28*** | (2006.01) |
| ***H01Q 9/26*** | (2006.01) |
| ***H01Q 21/28*** | (2006.01) |

(52) U.S. Cl.

CPC ..... *H01Q 1/38* (2013.01); *H01Q 5/371* (2015.01); *H01Q 9/065* (2013.01); *H01Q 9/265* (2013.01); *H01Q 9/285* (2013.01); *H01Q 21/28* (2013.01)

(58) Field of Classification Search

CPC ..... H01Q 9/065; H01Q 9/265; H01Q 9/285; H01Q 5/371; H01Q 1/38

USPC ..... 343/700 MS

See application file for complete search history.

(56) References Cited

U.S. PATENT DOCUMENTS

| | | | | |
|---|---|---|---|---|
| 7,768,471 | B2 * | 8/2010 | Su | H01Q 1/243 343/795 |
| 7,948,445 | B2 * | 5/2011 | Kuramoto | H01Q 1/273 343/860 |
| 2014/0132468 | A1 * | 5/2014 | Kim | H01Q 9/285 343/793 |
| 2014/0132469 | A1 * | 5/2014 | Wang | H01Q 1/2266 343/821 |
| 2014/0340261 | A1 * | 11/2014 | Mechaik | H01Q 1/36 343/700 MS |
| 2015/0372383 | A1 * | 12/2015 | Yoshida | H01Q 1/2291 343/853 |

* cited by examiner

*Primary Examiner* — Dameon E Levi
*Assistant Examiner* — Jennifer F Hu
(74) *Attorney, Agent, or Firm* — McClure, Qualey & Rodack, LLP

(57) ABSTRACT

A balance antenna capable of directly receiving an unbalanced signal includes a pair of radiating units symmetrical with respect to a symmetrical axis. Each radiating unit includes a high-frequency radiating part and a low-frequency radiating part. The high-frequency radiating part includes a frame, a feed-in arm extending from the frame and parallel to the symmetrical axis and having a feed-in point at a distal end thereof, and an enhancing arm extending from the frame and incline relative to the feed-in arm. The low-frequency radiating part extends from the frame and partially around the high-frequency radiating part, and is bent toward the feed-in arm. The low-frequency radiating part has a distal free end close to the feed-in point.

11 Claims, 4 Drawing Sheets

BALANCED ANTENNA

CROSS-REFERENCE TO RELATED APPLICATION

This application claims priority of Taiwanese Application No. 104212392, filed on Jul. 31, 2015.

FIELD

The disclosure relates to an antenna, and more particularly to a balanced antenna capable of directly receiving an unbalanced signal.

BACKGROUND

Referring to FIG. 1, a conventional dipole antenna capable of receiving digital television signals includes a pair of monopole antennas 500, and is disposed on a substrate 400. Each of the monopole antennas 500 is made of a metal sheet, and has two radiating parts 510 configured respectively for receiving high-frequency and low-frequency signals, and a feed-in arm 520 coupled to the radiating parts 510. The feed-in arm 520 has a feed-in point 521 disposed at a distal end thereof. With this configuration, the conventional dipole antenna can be designed according to different bandwidth requirements to generate a radiation pattern.

However, the conventional dipole antenna is a balanced antenna, and a coaxial cable that is used to feed the digital television signals to the conventional dipole antenna is an unbalanced type transmission line. If the coaxial cable is directly connected to the conventional dipole antenna, the radiation pattern of the conventional dipole antenna will be affected due to a high-frequency current passing through an outer conducting shield of the coaxial cable and originating from the conventional dipole antenna. Thus, a balun 530 is required to be connected to the feed-in points 521 of the monopole antennas 500 for preventing the coaxial cable from acting as an antenna and radiating power.

SUMMARY

Therefore, an object of the disclosure is to provide a balanced antenna that can alleviate at least one of the drawbacks of the prior arts.

According to the disclosure, the balanced antenna is capable of directly receiving an unbalanced signal. The balanced antenna includes a pair of radiating units that are symmetrical with respect to a symmetrical axis. Each of the radiating units includes a high-frequency radiating part and a low-frequency radiating part.

The high-frequency radiating part includes a frame, a feed-in arm, and an enhancing arm. The frame of the high-frequency radiating part has a junction point and a coupling point that are opposite to each other. The feed-in arm extends from the junction point away from the frame, and is parallel to the symmetrical axis and has a feed-in point at a distal end thereof. The enhancing arm extends from the junction point away from the frame and is inclined relative to the feed-in arm.

The low-frequency radiating part extends from the coupling point away from the frame and partially around the high-frequency part, and is bent toward the feed-in arm. The low-frequency radiating part has a distal free end close to the feed-in point.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
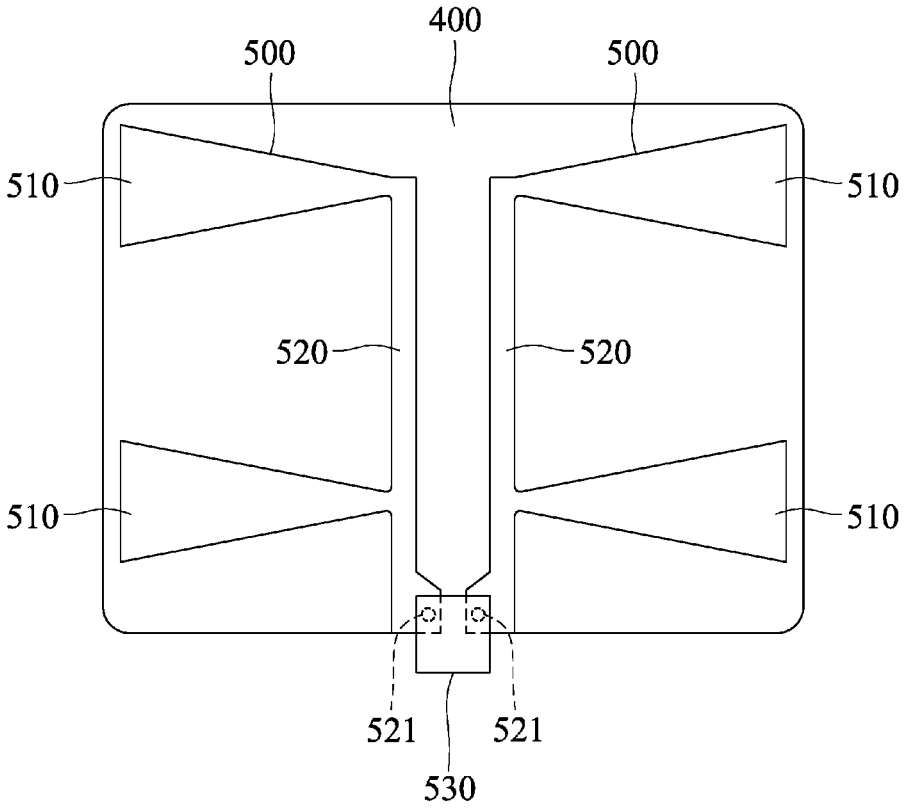
FIG.1 PRIOR ART
FIG. 1 is a schematic view of a conventional dipole antenna.

Before the disclosure is described in greater detail, it should be noted that like elements are denoted by the same reference numerals throughout the disclosure.

Figure 2:
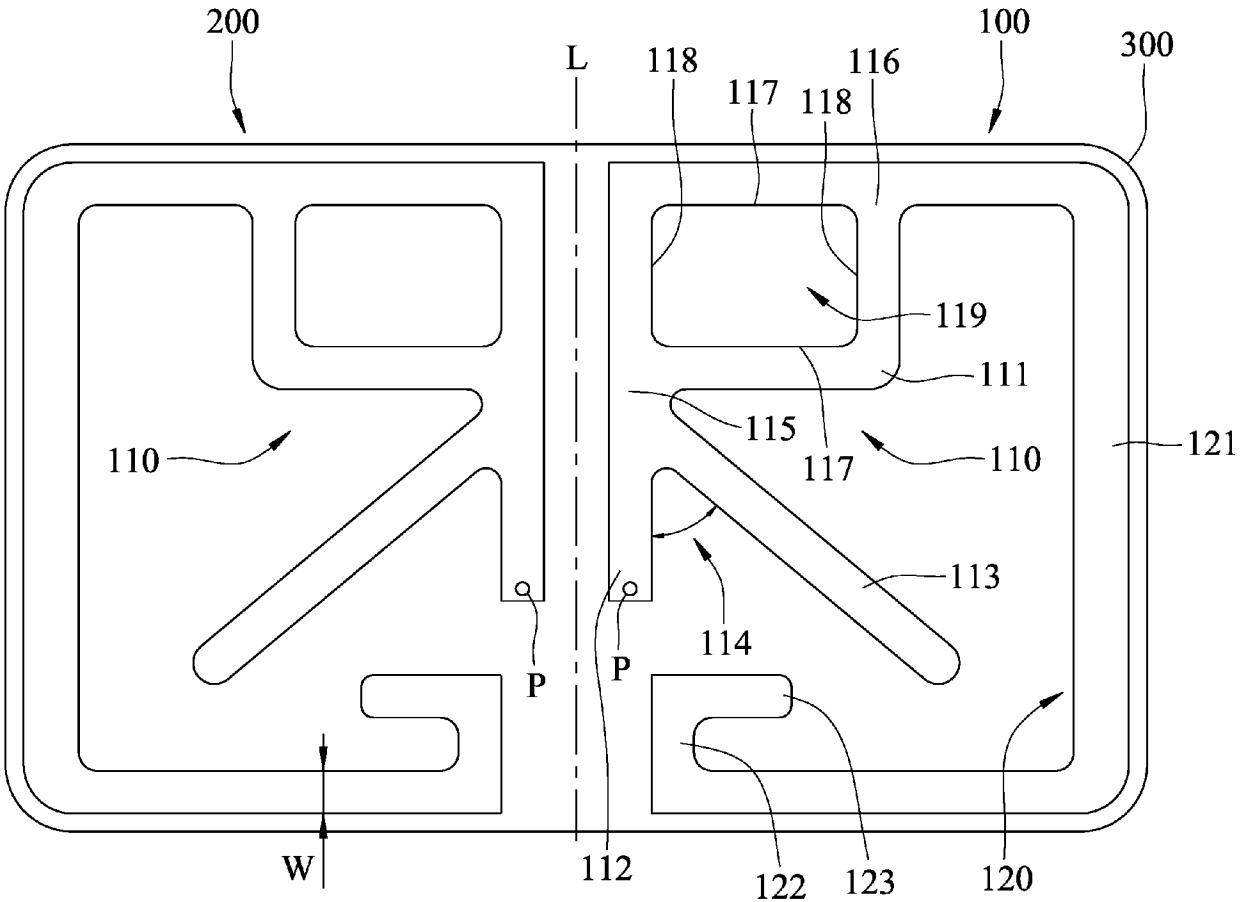
FIG. 2 is a schematic view of a first embodiment of a balanced antenna according to the disclosure.

Referring to FIG. 2, the first embodiment of a balanced antenna according to this disclosure is capable of directly receiving an unbalanced signal. The balanced antenna is disposed on a dielectric substrate 300 having a symmetrical axis (L). The dielectric substrate 300 is made of insulating material, such as plastic, fiberglass, etc. The balanced antenna is formed on the dielectric substrate 300 by forming metal conductor (such as that of silver, copper, etc.) on the dielectric substrate 300. According to different requirements, the dielectric substrate 300 may have flexibility or different colors.

The balanced antenna includes a first radiating unit 100 and a second radiating unit 200. The first radiating unit 100 and the second radiating unit 200 are symmetrical with respect to the symmetrical axis (L). Since structural configuration of the second radiating unit 200 is the same as that of the first radiating unit 100, only the first radiating unit 100 is described in the following description for the sake of brevity.

The first radiating unit 100 includes a high-frequency radiating part 110 and a low-frequency radiating part 120.

The high-frequency radiating part 110 includes a frame 111, a feed-in arm 112 and an enhancing arm 113. The frame 111 of the high-frequency radiating part 110 has a junction point 115 and a coupling point 116 that are opposite to each other. The frame 111 is substantially shaped as a rectangle, and further has two perpendicular segments 117 perpendicular to the symmetrical axis (L), two parallel segments 118 parallel to the symmetrical axis (L), and a rectangular area 119 surrounded by the perpendicular segments 117 and the parallel segments 118. The frame 111 has two diagonal corners, one of which is close to the symmetrical axis (L) and is provided with the junction point 115, and the other one of which is provided with the coupling point 116. The feed-in arm 112 extends from the junction point 115 away from the frame 111, is parallel to the symmetrical axis (L), and has a feed-in point (P) at a distal end thereof. The enhancing arm 113 extends from the junction point 115 away from the frame 111, and is inclined relative to the feed-in arm 112. The enhancing arm 113 and the feed-in arm 112 form an included angle 114.

The low-frequency radiating part 120 extends from the coupling point 116 away from the frame 111 and partially around the high-frequency radiating part 110, and is bent toward the feed-in arm 112. The low-frequency radiating part 120 has a distal free end 123 close to the feed-in point (P). The low-frequency radiating part 120 includes a connecting segment 121 and a hook segment 122. The connecting segment 121 is connected to the coupling point 116, and extends away from the frame 111 partially around the high-frequency radiating part 110 and curvedly toward the feed-in arm 112. In this embodiment, the connecting segment 121 projects from the coupling point 116 away from the symmetrical axis (L), then extends parallel to an extension direction of the feed-in arm 112, and then extends toward the symmetrical axis (L). The connecting segment 121 has a distal end close to the feed-in point (P), and two corners of about 90 degrees, and partially surrounds a rectangular area where the high-frequency radiating part 110 is disposed. The hook segment 122 is connected to the distal end of the connecting segment 121, and is substantially L-shaped. In particular, the hook segment 122 projects from the distal end of the connecting segment 121 toward the feed-in point (P) and then extends away from the symmetrical axis (L). the hook segment 122 has the distal free end 123.

By virtue of the above structural configuration and by matching impedance of each arm/segment of the balanced antenna, a high-frequency current will not flow from the balanced antenna to an outer conducting shield of a coaxial cable (not shown) that is directly connected to the feed-in points (P) of the first and second radiating units 100, 200 without a balun, so that the coaxial cable will not act as an antenna and radiate power and thus will not affect radiation pattern of the balanced antenna. Accordingly, detail configuration of the balanced antenna according to this disclosure (e.g., material, dimensions, layout and arrangement) needs to be carefully designed.

In this embodiment, for impedance matching and performance of the balanced antenna in receiving signals, the balanced antenna is made of silver which has the highest electric conductivity among ail metals, and dimensions of various parts of the balanced antenna are specifically designed to be within respective ranges. Each of the arms and segments 112, 113, 117, 118, 121 and 122 has a width (W) ranging from 5 mm to 15 mm. The length of the feed-in arm 112 ranges from 80 mm to 100 mm. The length of each of the perpendicular segments 117 ranges from 35 mm to 50 mm. The length of each of the parallel segments 118 ranges from 15 mm to 35 mm. The length of the enhancing arm 113 ranges from 70 mm to 100 mm. The included angle 114 between the feed-in arm 112 and the enhancing arm 113 ranges from 35 degrees to 60 degrees. As a result, the high-frequency radiating parts 110 of the first and second radiating units 100, 200 are configured together to operate in a high frequency band ranging from 400 MHz to 800 MHz. The length of an effective current path from the coupling point 116 to the feed-in point (P) of each of the first and second radiating units 100, 200 is substantially 125 mm, and is substantially equal to a quarter of a wavelength corresponding to a central frequency of the high frequency band. The enhancing arm 113 can act as an open-end microstrip for prohibiting the high-frequency current from flowing to the coaxial cable.

Further, the low-frequency radiating part 120 is designed to improve receiving efficiency of the balanced antenna at a frequency lower than 600 MHz. The length of the connecting segment 121 ranges from 245 mm to 370 mm. The length of the hook segment 122 ranges from 50 mm to 80 mm. The low-frequency radiating parts 120 of the first and second radiating units 100, 200 are configured together to operate in a low frequency band ranging from 150 MHz to 250 MHz. The length of an effective current path from the distal free end 123 of the hook segment 122 to the feed-in point (P) is substantially 375 mm, and is substantially equal to a quarter of a wavelength corresponding to a central frequency of the low frequency band.

Figure 4:
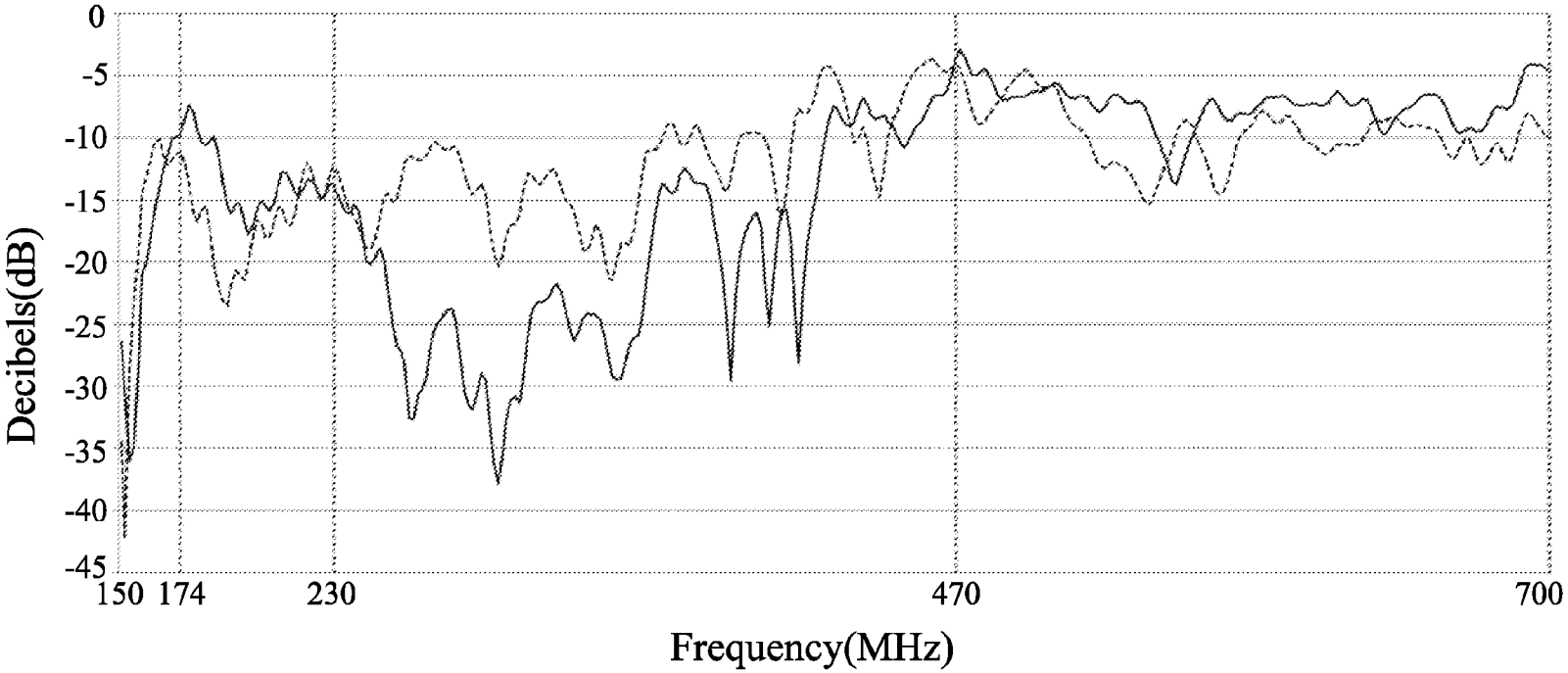
FIG. 4 is a plot illustrating the antenna gain of the balanced antenna and the conventional dipole antenna operating at a frequency band ranging from 150 MHz to 700 MHz.

FIG. 4 is a plot illustrating antenna gain of the balanced antenna according to the first embodiment (indicated by a solid line) and antenna gain of the conventional dipole antenna (indicated by a dotted line) operating at a frequency ranging from 174 MHz to 700 MHz. The performance of the balanced antenna at the frequency from 470 MHz to 700 MHz, which is usually used for digital television signals, is significantly enhanced. In addition, the performance of the balanced antenna at the frequency from 174 MHz to 230 MHz (very high frequency, VHF) is also improved. Thus, the balanced antenna is also adapted for receiving signals for short distance transmission, such as broadcasting signals and radio signals.

Figure 3:
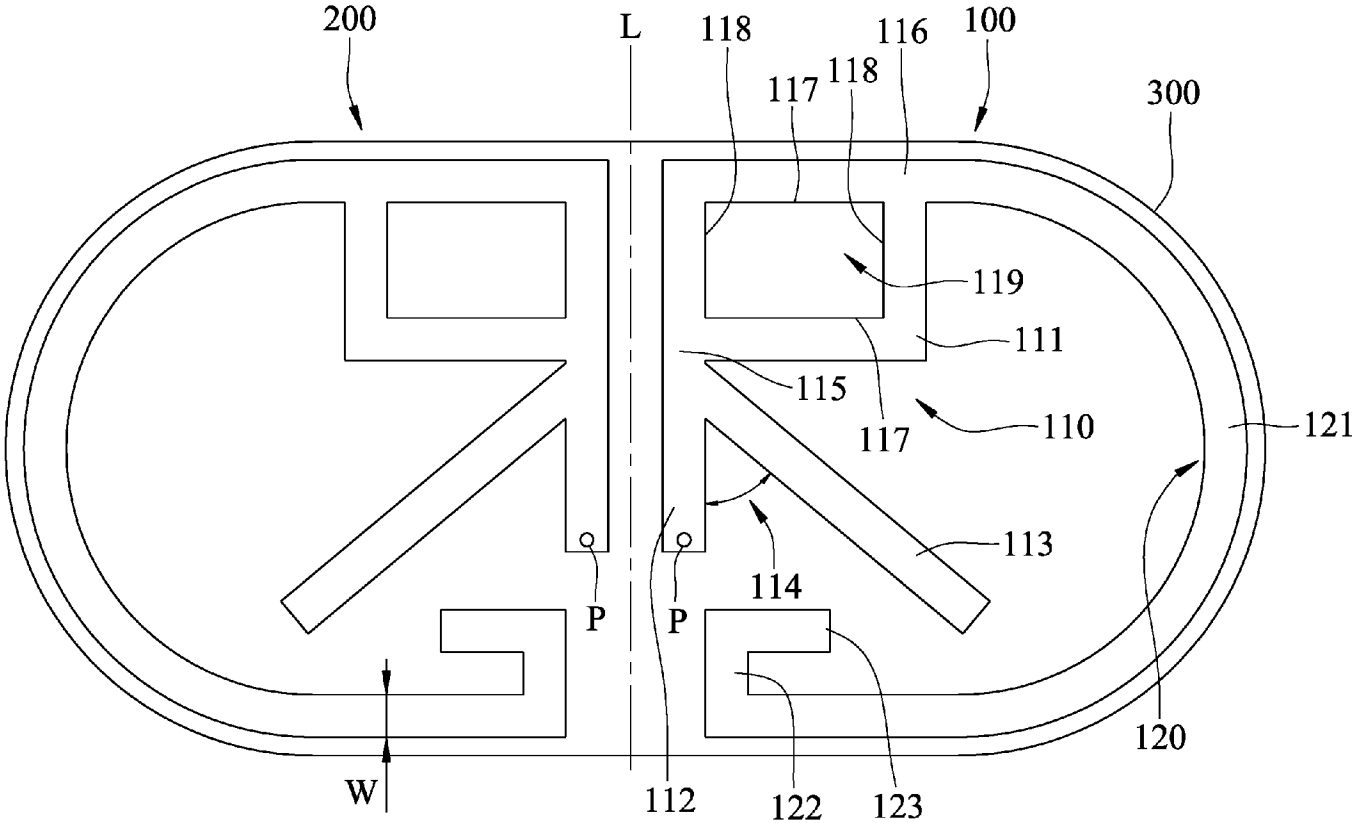
FIG. 3 is a schematic view of a second embodiment of a balanced antenna according to the disclosure.

It should be noted that an inner edge or a corner of a metal wire results in a focused electric field that may affect a radiation pattern. Referring to FIG. 3, the second embodiment of a balanced antenna according to this disclosure is similar to the first embodiment. In the second embodiment, the connecting segment 121 is continuously bent and curved from the coupling point 116 toward the feed-in point (P). The length of the connecting segment 121 is slightly shorter than that of the first embodiment, and ranges from 235 mm to 360 mm. Since the connecting segment 121 of this embodiment is continuously bent and does not have a corner, it will not result in a focused electric field. The performance of the balanced antenna of this embodiment is enhanced. Further, the balanced antenna of this embodiment has a different shape, and provides a different selection for customers.

Moreover, if the impedance of any arm/segment of the balanced antenna is changed, the impedance matching with a nearby arm/segment will be affected, and the performance of the balanced antenna may be adversely affected. Thus, the width (W) of each arm/segment of the balanced antenna should be fixed to prevent the impedance from changing.

In sum, by virtue of the enhancing arm 113 prohibiting the high-frequency current from flowing to the coaxial cable, one balanced antenna according to this disclosure does not require a balun, and manufacturing coat thereof is decreased. In addition, the balanced antenna is also adapted for receiving the signals of short distance transmission.

While the disclosure has been described in connection with what are considered the exemplary embodiments, it is understood chat this disclosure is not limited to the disclosed embodiments but is intended to cover various arrangements included within the spirit and scope of the broadest interpretation so as to encompass all such modifications and equivalent arrangements.

What is claimed is:

1. A balanced antenna capable of directly receiving an unbalanced signal, said balanced antenna comprising a pair of radiating units that are symmetrical with respect to a symmetrical axis, each of said radiating units includes:

a high-frequency radiating part including a frame that has a junction point and a coupling point opposite to each other, a feed-in arm that extends from said junction point away from said frame and parallel to the symmetrical axis and that has a feed-in point at a distal end thereof, and an enhancing arm that extends from said junction point away from said frame and that is inclined relative to said feed-in arm; and a low-frequency radiating part extending from said coupling point away from said frame and partially around said high-frequency radiating part, being bent toward said feed-in arm, and having a distal free end close to said feed-in point.

2. The balanced antenna as claimed in claim 1, wherein said radiating units are configured together to operate in a high frequency band, and a length of an effective current path from said coupling point to said feed-in point of each said radiating units is substantially equal to a quarter of a wavelength corresponding to a central frequency of the high frequency band.

3. The balanced antenna as claimed in claim 2, wherein said radiating units are configured together to operate in the high frequency band ranging from 400 MHz to 800 MHz.

4. The balanced antenna as claimed in claim 1, wherein said radiating units are configured together to operate in a low frequency band, and a length of an effective current path from a distal free end of said low-frequency radiating part to said feed-in point of each of said radiating units is substantially equal to a quarter of a wavelength corresponding to a central frequency of the low frequency band.

5. The balanced antenna as claimed in claim 4, wherein said radiating units are configured together to operate in the low frequency band ranging from 150 MHz to 250 MHz.

6. The balanced antenna structure as claimed in claim 1, wherein said frame is substantially shaped as a rectangle, and further has two perpendicular segments perpendicular to the symmetrical axis, two parallel segments parallel to the symmetrical axis, and a rectangular area surrounded by said perpendicular segments and said parallel segments.

7. The balanced antenna as claimed in claim 6, wherein said frame further has two diagonal corners, one of which is close to the symmetrical axis and is provided with the junction point, and the other one of which is provided with the coupling point.

8. The balanced antenna as claimed in claim 1, wherein said enhancing arm and said feed-in arm form an included angle ranging from 35 degrees to 60 degrees.

9. The balanced antenna as claimed in claim 1, wherein said enhancing arm has a length ranging from 70 mm to 100 mm.

10. The balanced antenna as claimed in claim 1, wherein said low-frequency radiating part of each of said radiating units includes:

a connecting segment connected to said coupling point, extending away from said frame, partially around said high-frequency radiating part, and curvedly toward said feed-in arm, said connecting segment having a distal end close to said feed-in point; and a hook segment having said distal free end, connected to said distal end, and projecting from said distal free end toward said feed-in point.

11. The balanced antenna as claimed in claim 9, wherein said hook segment is substantially L-shaped.

* * * * *